US010846998B1

(12) United States Patent
Hewitt

(10) Patent No.: US 10,846,998 B1
(45) Date of Patent: Nov. 24, 2020

(54) PIPE ORGAN DOORBELL

(71) Applicant: Stephan R. Hewitt, Rogersville (CA)

(72) Inventor: Stephan R. Hewitt, Rogersville (CA)

( * ) Notice: Subject to any disclaimer, the term of this patent is extended or adjusted under 35 U.S.C. 154(b) by 0 days.

(21) Appl. No.: 16/547,778

(22) Filed: Aug. 22, 2019

(51) Int. Cl.
*G08B 3/00* (2006.01)
*G10B 1/04* (2006.01)

(52) U.S. Cl.
CPC ..... *G08B 3/00* (2013.01); *G10B 1/04* (2013.01)

(58) Field of Classification Search
CPC ..... G08B 3/00; G01B 1/04
USPC ..... 340/6.1, 328, 330, 384.1, 393.3, 404.1
See application file for complete search history.

(56) References Cited

U.S. PATENT DOCUMENTS

| | | | | |
|---|---|---|---|---|
| 2,761,343 | A * | 9/1956 | Hammond, Jr. | G10H 3/00 84/741 |
| 3,701,833 | A * | 10/1972 | Bosche, Jr. | G10B 3/16 84/346 |
| D795,115 | S | 8/2017 | Parker et al. | |
| D795,728 | S | 8/2017 | Parker et al. | |
| D824,791 | S | 8/2018 | Scalisi | |
| 2007/0079467 | A1* | 4/2007 | Cunningham | A47L 5/38 15/314 |
| 2010/0245060 | A1* | 9/2010 | Tylicki | G08B 3/10 340/393.3 |

OTHER PUBLICATIONS

Nutone Door Chime 1950S Model K 23 Youtube With Doorbell Chimes Stunning Ideas Doorbell Chimes. Product Listing [online]. The Wooden Houses Design [retrieved on Apr. 10, 2019]. Retrieved from the Internet: <URL: https://copens.rickyhil.com/stunning-ideas-doorbell-chimes/nutone-door-chime-1950s-model-k-23-youtube-with-doorbell-chimes-stunning-ideas-doorbell-chimes/>.

Long Tubular Doorbell, Pine with Brass Tubes. Product Listing [online]. © 2019 DoorbellWorld [retrieved on Apr. 10, 2019]. Retrieved from the Internet: <URL: https://doorbellworld.co.uk/product_info.php/long-tubular-doorbell-pine-with-brass-tubes-p-347>.

Cinnamon Hill Art Pipe Organ Doorbell. Video [online]. YouTube.com [published on Nov. 24, 2012 by Andrew LaTorre; retrieved on Apr. 10, 2019]. Retrieved from the Internet: <URL: https://www.youtube.com/watch?v=aeEdZ2Pd7Mo>.

Cinnamon Hill Folk Art; Twelve-note Pipe Organ Doorbell. Product Listing [online]. Cinnamon Hill Art.com [retrieved on Apr. 10, 2019]. Retrieved from the Internet: <URL: http://www.cinnamonhillart.com/PipeOrgan.html>.

* cited by examiner

*Primary Examiner* — Hung T Nguyen
(74) *Attorney, Agent, or Firm* — Cramer Patent & Design, PLLC; Aaron R. Cramer

(57) ABSTRACT

A doorbell is in electrical communication with a trigger which is in further electrical communication with the audio alert. The audio alert is fashioned as a pipe organ or any pitch or octave.

20 Claims, 6 Drawing Sheets

PIPE ORGAN DOORBELL

RELATED APPLICATIONS

Not applicable.

FIELD OF THE INVENTION

The present invention relates generally to a doorbell and more specifically to a pipe organ doorbell.

BACKGROUND OF THE INVENTION

The doorbell is a common device found in almost any home. Most residents do not give it much thought as it performs its job very well with little maintenance or upkeep. In a typical installation, the sound it produces matches the appearance of the sounder on the wall; fairly non-descript and boring.

While some sounders can produce a wide variety of tunes or even music, the enclosure is still usually hidden away in a cabinet that blends into the décor. Those shopping for a sounder that looks as grand and luxurious as the sound it produces are usually disappointed. Accordingly, there exists a need for a means by which a doorbell sounder can produce a rich, deep sound from an enclosure that aesthetically pleasing to look at. The development of the pipe organ doorbell fulfills this need.

SUMMARY OF THE INVENTION

The principles of the present invention provide for a pipe organ doorbell, comprising a lower closed enclosure housing one or more electrotechnical devices for producing a controlled air flow which drives at least one organ pipe. The at least one organ pipe rests upon a top surface of the decorative lower enclosure where it is coupled to a blower with a section of flexible hose. The at least one organ pipe rest in a captive position between the top surface and a first bottom surface of the top enclosure. The pipe organ doorbell also comprises an upper open enclosure including a backplane, a pair of front supports, and a top enclosure. The decorative upper open enclosure provides viewing of at least one organ pipe arranged in a vertical manner. The pipe organ doorbell also comprises an AC power cable electrically powering the pipe organ doorbell by an AC power cable controlled via a low voltage cable. The power cable and the low voltage cable are penetrating a second bottom surface provided on the decorative lower enclosure.

The pipe organ doorbell also comprises a timing relay disposed on the fore-right side of the pipe organ doorbell. The output of the timing relay is then routed to the motor speed control which governs the speed of a blower motor. The timing relay will close the circuit for a predetermined amount of time whenever a doorbell pushbutton switch is pushed. The pipe organ doorbell also comprises a step-down transformer wired in series with the doorbell pushbutton switch and a power resistor which serves to limit the current and prevent inadvertent operation of the timing relay from stray currents, a motor speed control which is wired in series with the blower motor, a motor speed control shaft which is located in an access hole that is part of the motor speed control, an inlet duct which is provided to serve as an air supply source for the blower that is filled with a sponge to filter the incoming air and deaden the sound of the blower motor, and an optional lighting element which may be mounted on the top enclosure to emphasize an aesthetic appeal of the pipe organ doorbell. The lighting element may be connected to a control element which is in turn connected to a power source in an independent manner for power.

Power for the pipe organ doorbell may be derived from an AC power outlet power source. The power for the pipe organ doorbell may be derived from a direct hardwired power connection power source. The power may then be routed to a primary side of the step-down transformer as well as to one output contact of the timing relay which is wired to serve as an off delay. The pipe organ doorbell may be four feet tall, ten inches wide, and ten inches deep. The first bottom surface may be visible on the rear-left side of the pipe organ doorbell. The flexible hose may be visible on the rear-left side of the pipe organ doorbell. The blower may be disposed on the rear-left side of the pipe organ doorbell. The at least one organ pipe may rest upon a top surface of the decorative lower enclosure where it is coupled to the blower with a section of flexible hose via friction fit. Further support of the top enclosure may be provided by the backplane and the front support. The power cable and the low voltage cable may exit at the rear of the second bottom surface on the decorative lower enclosure.

The predetermined amount of time may be in the range of zero to twelve seconds. The step-down transformer may be disposed on the fore-right side of the pipe organ doorbell. The step-down transformer may be a 120 VAC/24 VAC transformer. The doorbell pushbutton switch may be equipped with a glow light. The main power resistor may be a Uxcell ten Watt, one-hundred twenty-ohm power resistor. The motor speed control may include a variable motor speed control 5-amp with a 120-VAC rating. The motor speed control shaft may allow the user to turn the motor speed control shaft with a screwdriver to adjust the speed of the blower motor to produce an acoustically pleasing sound. The lighting element may be selected from the group consisting of a spotlight, a light-emitting diode strip light, or a night light. The control element may be selected from the group consisting of a manual switch, a timer, or an occupancy sensor.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
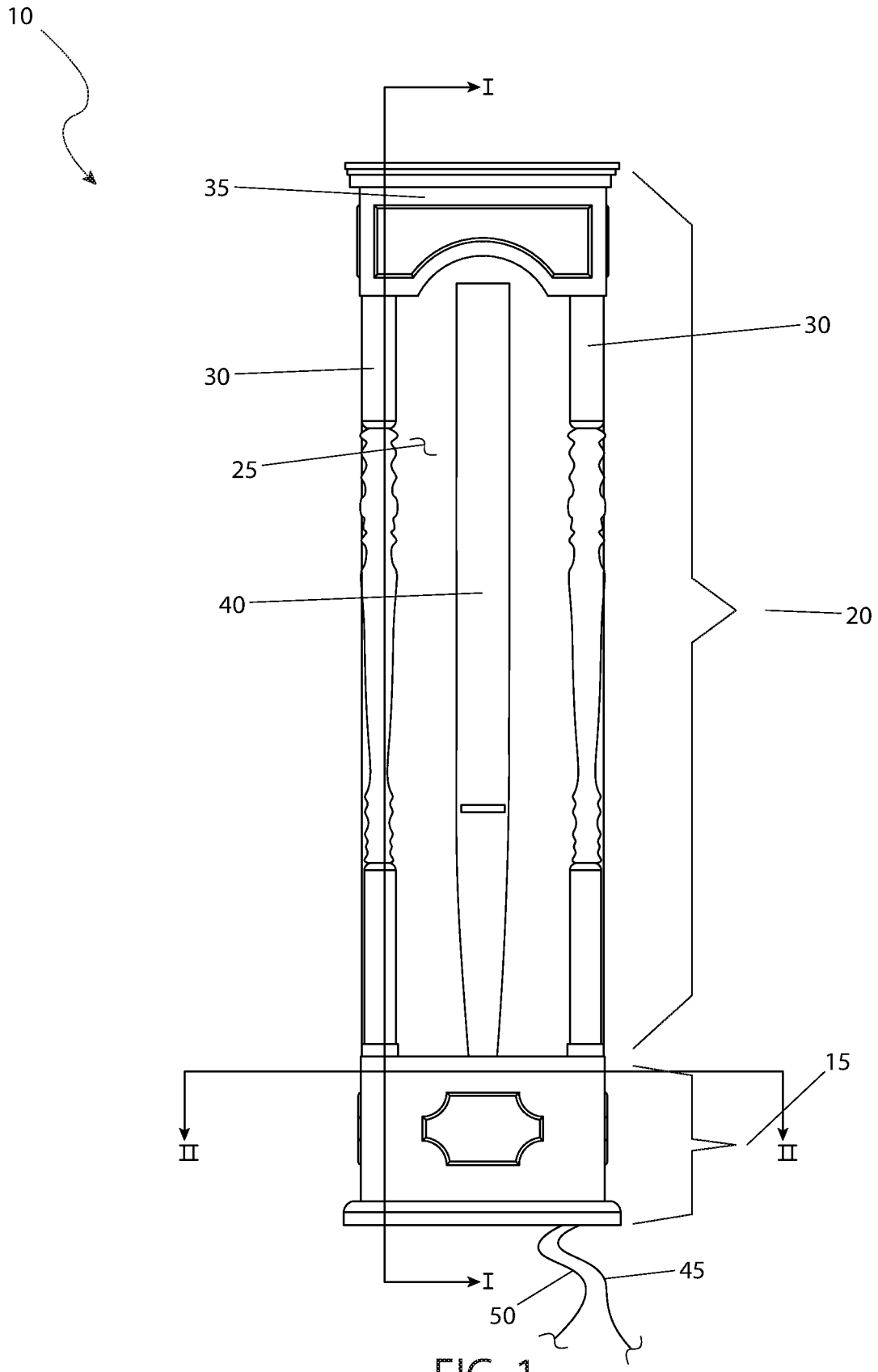
FIG. 1 is a perspective view of the pipe organ doorbell 10, according to a preferred embodiment of the present invention.

10 pipe organ doorbell
15 decorative lower enclosure

20 decorative upper enclosure
25 backplane
30 front support
35 top enclosure
40 organ pipe
45 power cable
50 low voltage cable
55 top surface
60 blower
65 flexible hose
70 first bottom surface
75 blower motor
80 timing relay
85 step down transformer
90 second bottom surface
95 motor speed control
100 power resistor
105 motor speed control shaft
110 access hole
115 inlet duct
120 sponge
125 power source
130 doorbell switch
135 lighting element
140 control element

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Referring now to FIG. 1, a perspective view of the air operated organ pipe doorbell 10, according to the preferred embodiment of the present invention is disclosed. The air operated organ pipe doorbell 10 (herein also described as the "doorbell") 10, includes a decorative lower enclosure 15 and decorative upper enclosure 20. The doorbell 10 is generally suitable for wall mounting; however, placement on a counter, cabinet, shelf, or even floor is possible. As such, the specific mounting/installation location of the doorbell 10 is not intended to be a limiting factor of the present invention.

The decorative upper enclosure 20 is of a generally open nature and includes a backplane 25, two (2) front supports 30, and a top enclosure 35. This configuration provides viewing of at least one (1) organ pipes 40 arranged in a vertical manner. The decorative lower enclosure 15 is completely enclosed and houses electrotechnical devices for producing a controlled air flow which drives the organ pipe 40 to produce the desired sound. Further details on interior items of the decorative lower enclosure 15 will be provided herein below. The overall size of the doorbell 10 is envisioned to be four feet (4 ft.) tall, ten inches (10 in.) wide, and ten inches (10 in.) deep. However, those skilled in the art will realize that other sizes, both larger and smaller are within the teachings of the present invention. Generally, longer (taller) versions of the doorbell 10 will produce lower frequency tones, while smaller (shorter) versions of the doorbell 10 will produce higher frequency tones. Overall arrangement of the decorative lower enclosure 15, the decorative upper enclosure 20 and the organ pipe 40 is intended to be aesthetically pleasing to look at and may be made in a wide variety of styles and colors. It is intended to be a decorative item in a household in much the same manner as a fine piece of furniture, artwork or the like. As such, it is noted that the overall size, color, style, and materials of construction of the doorbell 10 is not intended to be a limiting factor of the present invention. The doorbell 10 is electrically powered by a power cable 45 (AC) and controlled via a low voltage cable 50. Further description of the power cable 45 and the low voltage cable 50 will be provided herein below.

Figure 2:
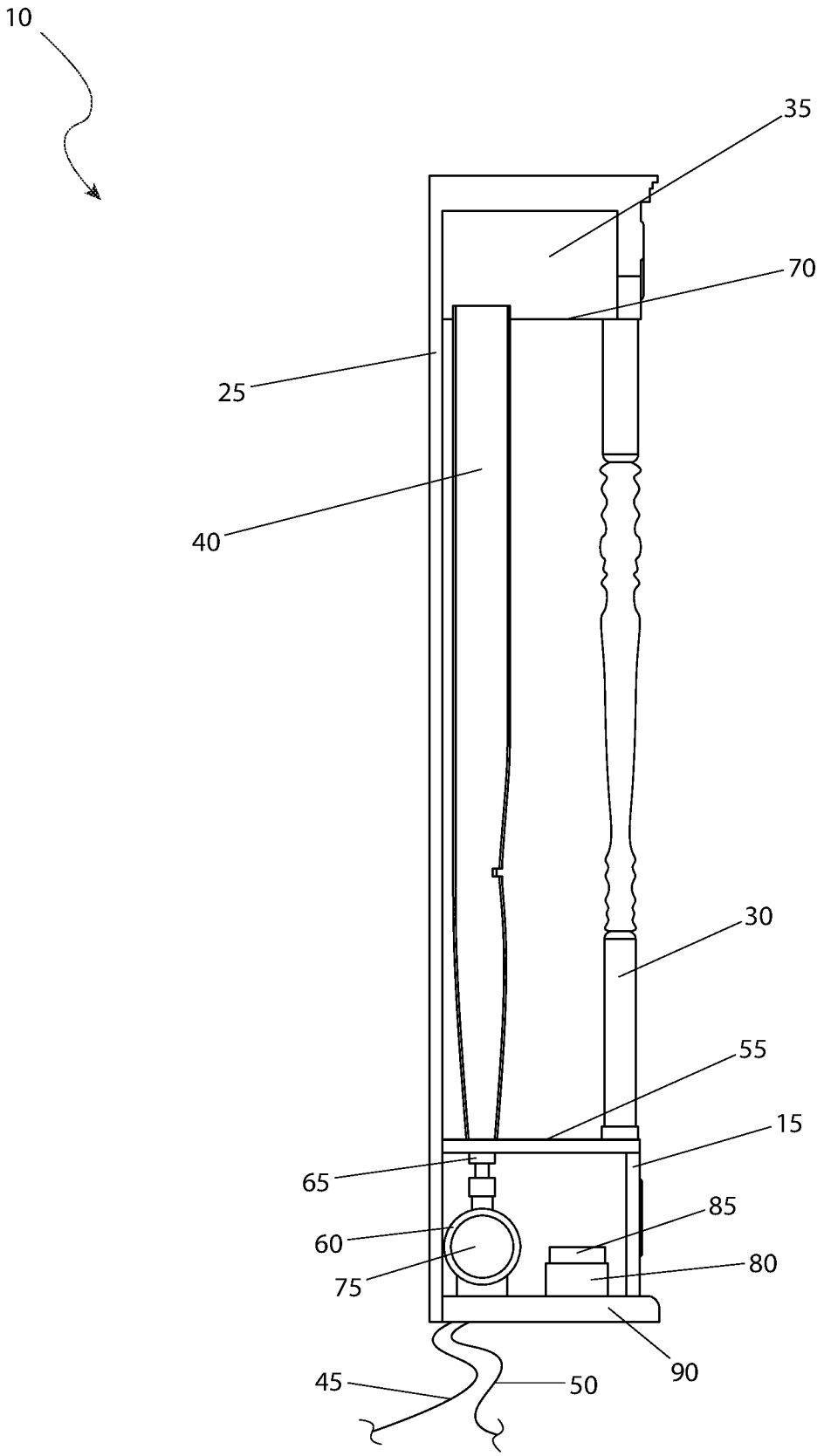
FIG. 2 is a sectional view of the pipe organ doorbell 10, as seen along a line I-I, as shown in FIG. 1, according to the preferred embodiment of the present invention.

Referring next to FIG. 2, a sectional view of the doorbell 10, as seen along a line I-I, as shown in FIG. 1, according to the preferred embodiment of the present invention is depicted. The organ pipes 40 rests upon a top surface 55 of the decorative lower enclosure 15 where it is coupled to a blower 60 with a section of flexible hose 65 via friction fit. The organ pipes 40 then rests in a captive position between the top surface 55 and a first bottom surface 70 of the top enclosure 35. Further support of the top enclosure 35 is provided by the backplane 25 and the front support 30. It is noted that the blower 60 is the only mechanical component in the decorative lower enclosure 15. Other electrical components such as blower motor 75, a timing relay 80 and a step-down transformer 85, are visible in this view and will be described in greater detail herein below. The power cable 45 and the low voltage cable 50 are visible penetrating a second bottom surface 90 provided on the decorative lower enclosure 15.

Figure 3:
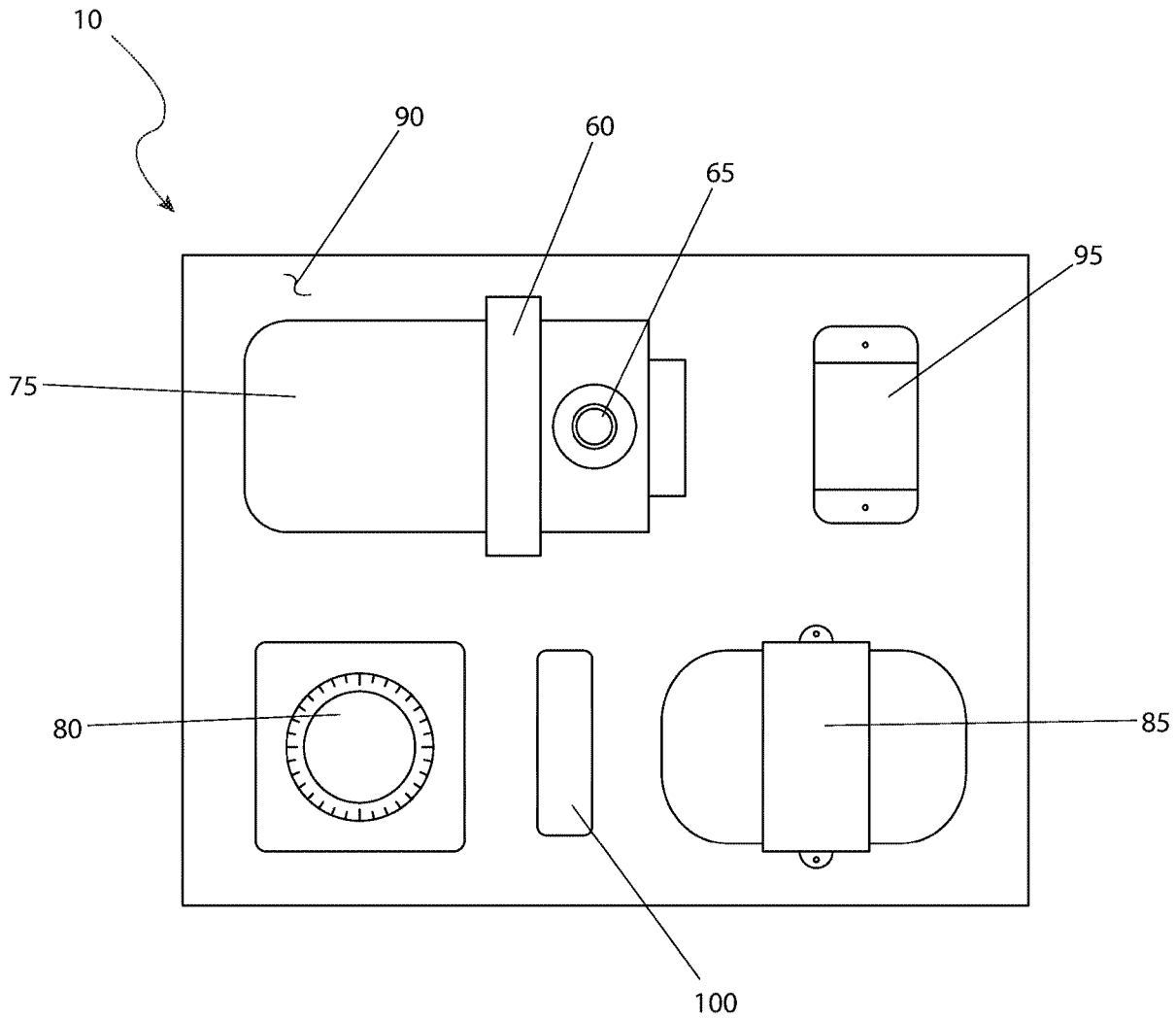
FIG. 3 is a sectional view of the pipe organ doorbell 10, as seen along a line II-II, as shown in FIG. 1, according to the preferred embodiment of the present invention.

Referring now to FIG. 3, a sectional view of the doorbell 10, as seen along a line II-II, as shown in FIG. 1, according to the preferred embodiment of the present invention is shown. All electromechanical components are shown mounted on the second bottom surface 90. As aforementioned described, the blower 60, the flexible hose 65, and the first bottom surface 70, are visible on the rear-left side. The timing relay 80 and the step-down transformer 85 are visible on the fore-right side. Also visible is a motor speed control 95 and a power resistor 100. The blower 60 and the blower motor 75 is envisioned to be an INTEX Electric Pump, Quick-fill, 110-120 vac or equal. The step-down transformer 85 is envisioned to be a 120 VAC/24 VAC transformer as provided by Amazon.com, Inc. or equal. The motor speed control 95 is envisioned to be a variable motor speed control 5-amp, 120-VAC rating by Amazon.com, Inc. or equal. The timing relay 80 is envisioned to be an Omrom time delay relay, zero to twelve seconds (0-12 s), Mod. H3CR, 24-VAC input, 250-VAC output with plug in base/socket or equal. The power resistor 100 is envisioned to be a Uxcell ten Watt (10 W), one-hundred twenty ohm (120Ω) power resistor or equal.

Figure 4:
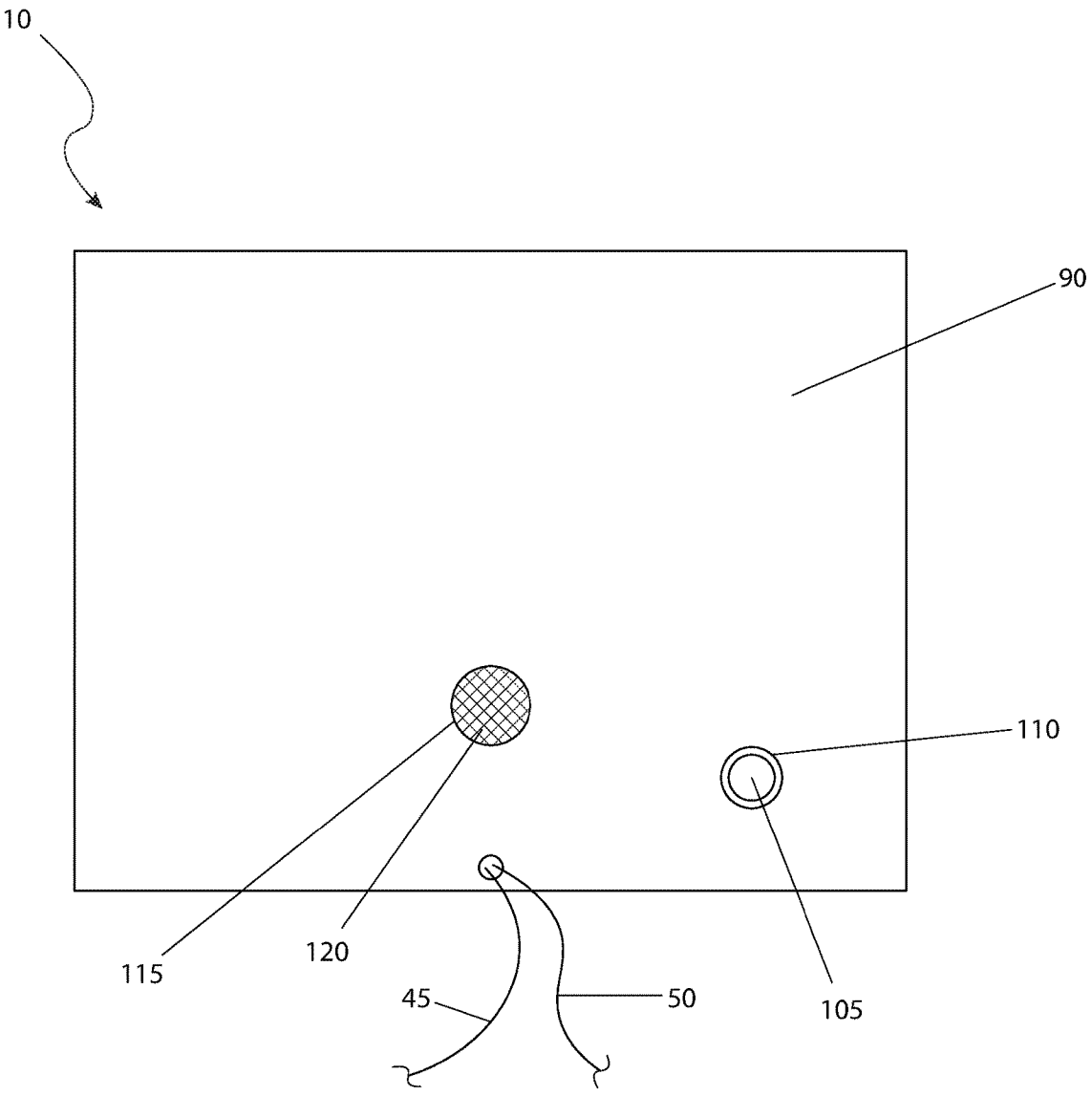
FIG. 4 is a bottom view of the pipe organ doorbell 10, according to the preferred embodiment of the present invention.

Referring next to FIG. 4, a bottom view of the doorbell 10, according to the preferred embodiment of the present invention is disclosed. This view primarily discloses the second bottom surface 90 viewable from the bottom of the doorbell 10. The power cable 45 and the low voltage cable 50 are seen exiting at the rear of the second bottom surface 90. A motor speed control shaft 105 is located in an access hole 110 and is part of the motor speed control 95 (as shown in FIG. 3). This configuration allows the user to turn the motor speed control shaft 105 with a screwdriver to adjust the speed of the blower motor 75 (as shown in FIG. 2) to produce an acoustically pleasing sound. An inlet duct 115 is provided to serve as an air supply source for the blower 60 (as shown in FIG. 2) and is filled with sponge 120 to filter the incoming air and deaden the sound of the blower motor 75.

Figure 5:
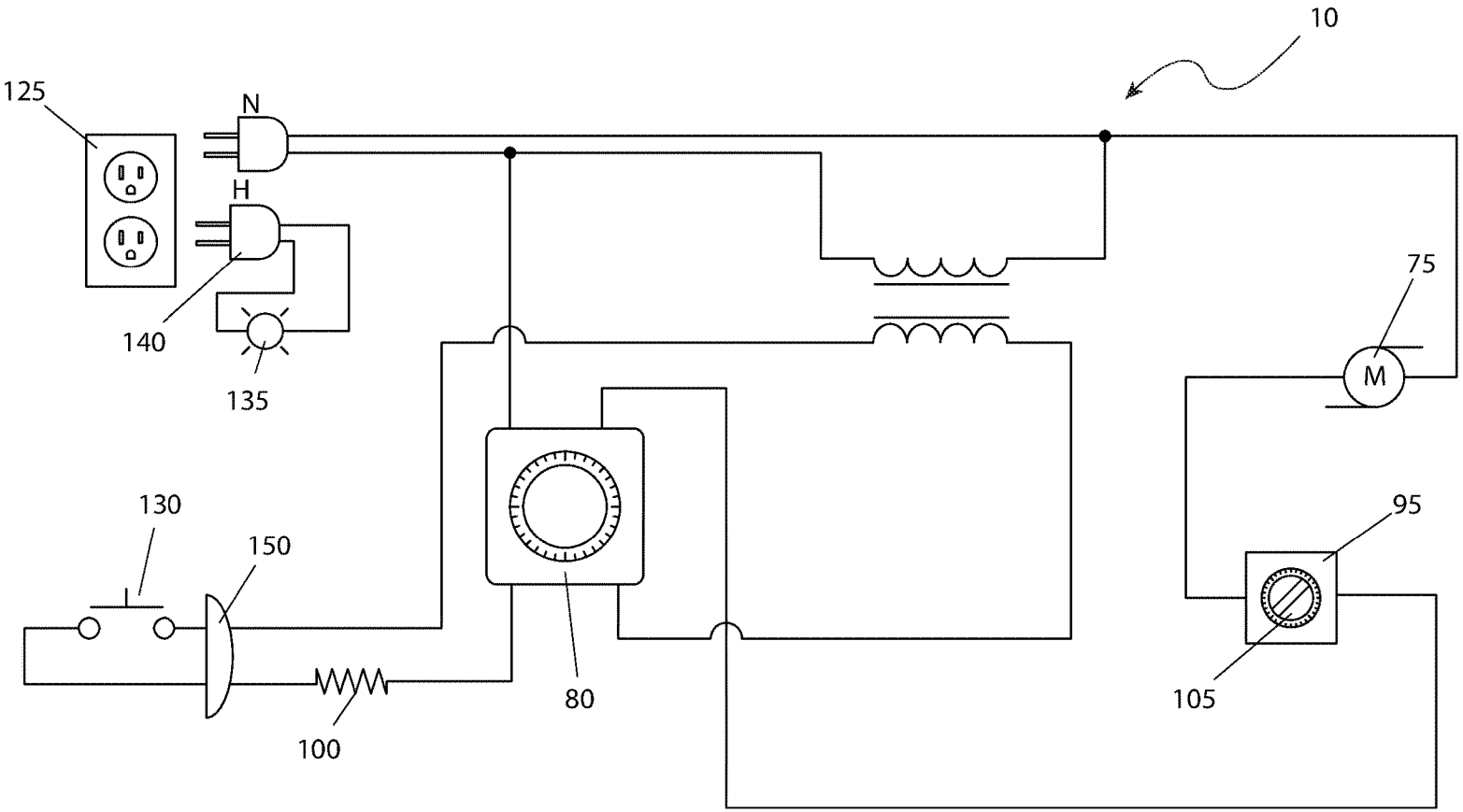
FIG. 5 is an electrical block diagram of the pipe organ doorbell 10, according to the preferred embodiment of the present invention; and, FIG. 6 is a perspective view of the pipe organ doorbell 10, according to an alternate preferred embodiment of the present invention.

Referring finally to FIG. 5, an electrical block diagram of the doorbell 10, according to the preferred embodiment of the present invention is depicted. Power for the doorbell 10 is derived from a power source 125 such as an AC power outlet or direct hardwired power connection. Power is then routed to the primary side of the step-down transformer 85 as well as to one (1) output contact of the timing relay 80 which is wired to serve as an off-delay. As such, the timing relay 80 will close the circuit for a predetermined amount of time (for example six seconds (6 s)) whenever a doorbell pushbutton switch 130 is pushed (even if only for a split second). The secondary side of the step down transformer 85 is wired in series with the doorbell pushbutton switch 130 and the power resistor 100 which serves to limit the current and prevent inadvertent operation of the timing relay 80, especially from stray currents such as a doorbell pushbutton switch 130 that may be equipped with a glow light. The output of the timing relay 80 is then routed to the motor speed control 95 which governs the speed of the blower motor 75. The motor speed control is wired in series with the blower motor 75. The motor speed control shaft 105 is visible on the motor speed control 95.

Figure 6:
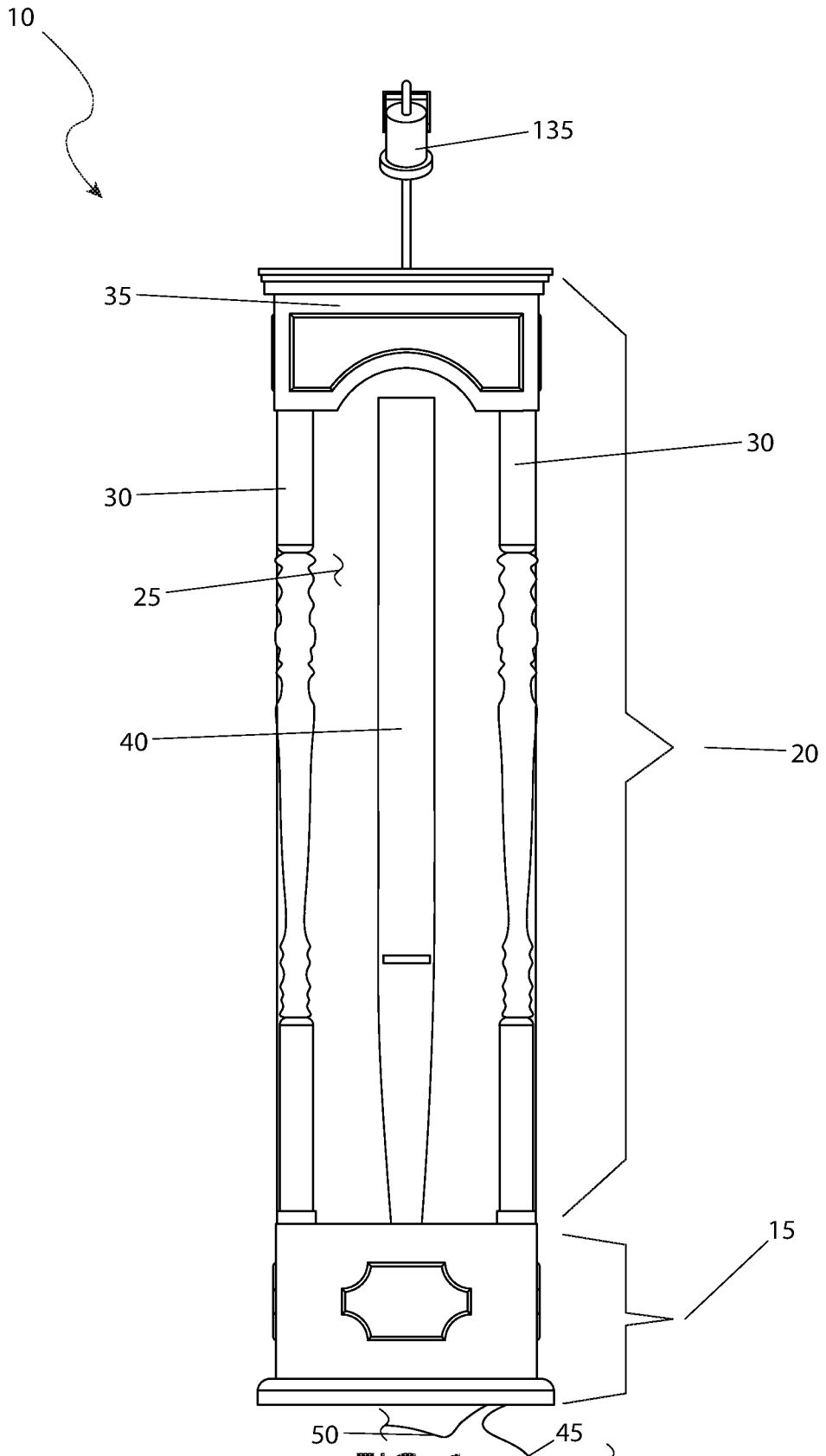

Referring now to FIG. 6, as an option, a lighting element 135 such as a spot light, a light-emitting diode (LED) strip light, a night light, or the like may be mounted on the top enclosure 35 (as shown in FIG. 1) to emphasize the overall aesthetic appeal of the doorbell 10. The lighting element 135 would be connected to a control element 140, such as a manual switch, timer, occupancy sensor, or the like which is in turn connected to power source 125 in an independent manner for power.

2. OPERATION OF THE PREFERRED EMBODIMENT

The preferred embodiment of the present invention can be utilized by the common user in a simple and effortless manner with little or no training. It is envisioned that the doorbell 10 would be constructed in general accordance with FIG. 1 through FIG. 5, or alternately in FIG. 6. The user would procure the doorbell 10 from conventional procurement channels such as fine furniture stores, department stores, lighting stores, internet or mail order stores, or the like. Special attention would be paid to the overall size of the doorbell 10, color and style of the doorbell 10, tone or frequency of the organ pipe 40, number of organ pipes 40, and the like.

After procurement and prior to utilization, the doorbell 10 would be prepared in the following manner: a suitable installation location would be chosen for the doorbell 10 such as a foyer, central hallway, or the like, doorbell 10 would be table mounted or wall mounted using suitable fasteners, a connection to a power source 125 using the power cable 45 would be made, and an electrical connection to a standard doorbell pushbutton switch 130 would be made using the low voltage cable 50. At this point in time the doorbell 10 would be tested and the overall sound adjusted using the motor speed control shaft 105 of the motor speed control 95 for the tone, while the timing relay 80 would be manipulated to control the overall time period of operation. At this point in time, the doorbell 10 is ready for utilization.

During utilization of the doorbell 10, the following procedure would be initiated: the doorbell pushbutton switch 130 would be pressed by visitors when they wish to speak to resident occupants in the normal manner. Both the visitor and the occupant are rewarded with a rich harmonious sound from the organ pipe 40.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A pipe organ doorbell, comprising:

a lower closed enclosure housing one or more electrotechnical devices for producing a controlled air flow which drives at least one organ pipe, the at least one organ pipe rests upon a top surface of a decorative lower enclosure where it is coupled to a blower with a section of flexible hose, the at least one organ pipe rest in a captive position between the top surface and a first bottom surface of the top enclosure;

an upper open enclosure including a backplane, a pair of front supports, and a top enclosure, a decorative upper open enclosure provides viewing of at least one organ pipe arranged in a vertical manner;

an AC power cable electrically powering the pipe organ doorbell by an AC power cable controlled via a low voltage cable, the power cable and the low voltage cable are penetrating a second bottom surface provided on the decorative lower enclosure;

a timing relay disposed on a fore-right side of the pipe organ doorbell, an output of the timing relay is then routed to a motor speed control which governs a speed of a blower motor, the timing relay will close a circuit for a predetermined amount of time whenever a doorbell pushbutton switch is pushed;

a step-down transformer wired in series with the doorbell pushbutton switch and a power resistor which serves to limit a current and prevent inadvertent operation of the timing relay from stray currents;

the motor speed control wired in series with the blower motor;

a motor speed control shaft located in an access hole that is part of the motor speed control; and, an inlet duct provided to serve as an air supply source for the blower that is filled with a sponge to filter an incoming air and deaden a sound of the blower motor.

2. The pipe organ doorbell according to claim 1, wherein the powering for the pipe organ doorbell is derived from an AC power outlet power source.

3. The pipe organ doorbell according to claim 1, wherein the powering for the pipe organ doorbell is derived from a direct hardwired power connection power source.

4. The pipe organ doorbell according to claim 3, wherein the powering is then routed to a primary side of the step-down transformer as well as to one output contact of the timing relay which is wired to serve as an off delay.

5. The pipe organ doorbell according to claim 1, wherein the pipe organ doorbell is four feet tall, ten inches wide, and ten inches deep.

6. The pipe organ doorbell according to claim 1, wherein the first bottom surface is visible on the rear-left side of the pipe organ doorbell.

7. The pipe organ doorbell according to claim 1, wherein the flexible hose is visible on the rear-left side of the pipe organ doorbell.

8. The pipe organ doorbell according to claim 1, wherein the blower is disposed on the rear-left side of the pipe organ doorbell.

9. The pipe organ doorbell according to claim 1, wherein the at least one organ pipe rests upon a top surface of the decorative lower enclosure where it is coupled to the blower with a section of flexible hose via friction fit.

10. The pipe organ doorbell according to claim 1, wherein further support of the top enclosure is provided by the backplane and the front support.

11. The pipe organ doorbell according to claim 1, wherein the power cable and the low voltage cable exit at the rear of the second bottom surface on the decorative lower enclosure.

12. The pipe organ doorbell according to claim 1, wherein the predetermined amount of time is in the range of zero to twelve seconds.

13. The pipe organ doorbell according to claim 1, wherein the step-down transformer is disposed on the fore-right side of the pipe organ doorbell.

14. The pipe organ doorbell according to claim 1, wherein the step-down transformer is a 120 VAC/24 VAC transformer.

15. The pipe organ doorbell according to claim 1, wherein the doorbell pushbutton switch is equipped with a glow light.

16. The pipe organ doorbell according to claim 1, wherein the power resistor is a Uxcell ten Watt, one-hundred twenty-ohm power resistor.

17. The pipe organ doorbell according to claim 1, wherein the motor speed control includes a variable motor speed control 5-amp with a 120-VAC rating.

18. The pipe organ doorbell according to claim 1, wherein the motor speed control shaft allows the user to turn the motor speed control shaft with a screwdriver to adjust the speed of the blower motor to produce an acoustically pleasing sound.

19. The pipe organ doorbell according to claim 1, further comprising a lighting element mounted on the top enclosure to emphasize an aesthetic appeal of the pipe organ doorbell, the lighting element is connected to a control element which is in turn connected to a power source in an independent manner for power; wherein an optional lighting element is selected from a group consisting of a spotlight, a light-emitting diode strip light, or a night light.

20. The pipe organ doorbell according to claim 1, wherein the control element is selected from a group consisting of a manual switch, a timer, or an occupancy sensor.

* * * * *